US006073633A

United States Patent [19]

Herman

[11] Patent Number: 6,073,633

[45] Date of Patent: Jun. 13, 2000

[54] SAFETY SMOKING PIPE WITH INTERNAL ASH-CLEANING AND TOBACCO-PACKING MECHANISMS

[76] Inventor: Arthur L. Herman, 514 Poplar Forest Dr., Forest, Va. 24551

[21] Appl. No.: 09/215,520

[22] Filed: Dec. 18, 1998

[51] Int. Cl.[7] ..... A24F 3/02; A24F 1/26; A24F 1/12; A24F 1/28

[52] U.S. Cl. ..... 131/184.1; 131/180; 131/181; 131/182; 131/184.3; 131/174; 131/191

[58] Field of Search ..... 131/180, 181, 131/184.1, 184.3, 174, 182, 176, 225, 191, 207

[56] References Cited

U.S. PATENT DOCUMENTS

| | | | |
|---|---|---|---|
| 34,745 | 3/1862 | Ernst . | |
| 136,487 | 3/1873 | Buynitzky . | |
| 459,077 | 9/1891 | Lauhoff . | |
| 561,288 | 6/1896 | Sondheim . | |
| 573,064 | 12/1896 | Vester . | |
| 1,319,358 | 10/1919 | Raje . | |
| 1,344,874 | 6/1920 | Flajollet | 131/178 |
| 1,359,803 | 11/1920 | Harnsberger . | |
| 2,099,926 | 11/1937 | Bruder . | |
| 2,162,500 | 6/1939 | Bruder . | |
| 2,546,237 | 3/1951 | Rehfeld . | |
| 3,065,756 | 11/1962 | Davies . | |
| 3,106,922 | 10/1963 | Hefti . | |

FOREIGN PATENT DOCUMENTS

| | | |
|---|---|---|
| 559089 | 9/1923 | France . |
| 240730 | 10/1925 | United Kingdom . |

*Primary Examiner*—James Derrington
*Assistant Examiner*—Dionne A. Walls
*Attorney, Agent, or Firm*—Nixon & Vanderhye

[57] ABSTRACT

The safety smoking pipe includes first and second parts telescopically receivable one within the other and rotatable relative to one another. The first part includes an elongated tube having a screen adjacent one end. The second part includes an elongated tube terminating at its proximal end in a pipe tip and having an axially extending cleaning member terminating in a cleaning head. A packing element is disposed for sliding movement along the cleaning rod. The tobacco materials are charged into the first tube, the tobacco materials adjacent the screen end are lit, and the ash being formed on the interior of the screen extinguishing the tobacco materials after a few puffs. By rotating the parts relative to one another, the cleaning head may clean the ash from the end of the pipe. By shaking the pipe screen end down, the weight repacks the tobacco material in the tube whereby the smoking materials can once again be ignited.

14 Claims, 2 Drawing Sheets

34
36
14
18
30
22
32
26
20
24
16
12
35

30
36
38
39

SAFETY SMOKING PIPE WITH INTERNAL ASH-CLEANING AND TOBACCO-PACKING MECHANISMS

TECHNICAL FIELD

The present invention relates to a safety smoking pipe for smoking tobacco in which the pipe is self-extinguishing after a predetermined limited number of puffs.

BACKGROUND

One of the great dangers of lighted tobacco materials is the very distinct possibility of causing a fire. For example, smokers have been known to drop lighted tobacco materials onto a carpet or into a chair. Often, the materials cannot be located prior to the start of a fire. Additionally, smokers have also fallen asleep while smoking which, of course, increases the danger from dropped lighted tobacco materials. Accordingly, there is a need for a safety pipe enabling a smoker to smoke tobacco materials wherein the smoking pipe is self-extinguishing and wherein the lighted materials are not exposed to potential flammable materials even if dropped.

Further, many smokers make efforts to curtail or altogether stop smoking. Oftentimes those efforts do not reach the desired result, even with the ancillary aids currently on the market, for example, patches, gum and the like. Accordingly, there is a further need for a pipe enabling a smoker to effectively reduce his/her nicotine intake.

Still further, secondhand smoke has become an issue in today's environment. The free burning of tobacco materials exposed to the air while the smoker is holding the smoking device or has placed it in an ashtray creates substantial secondhand smoke. Thus, there is a still further need for a pipe enabling a smoker to substantially reduce secondhand smoke.

DISCLOSURE OF THE INVENTION

In accordance with the present invention, there is provided a safety smoking pipe which is self-extinguishing after a predetermined limited number of puffs in which the burning tobacco materials are substantially retained within the pipe and not exposed externally. Additionally, the safety smoking pipe of the present invention contains devices internal to the pipe facilitating those ends. For example, an internal cleaning rod is provided for removing ashes. An internal device is also provided for packing and repacking the tobacco within the pipe. Thus, the tobacco materials loaded into the pipe can be periodically lit so that the smoker once again smokes the pipe for a predetermined limited number of puffs before the pipe self-extinguishes. Because the smoking pipe is self-extinguishing after a predetermined limited number of puffs, it can be used as an aid to curtail or stop smoking. That is, instead of smoking the entirety of tobacco materials contained within pipes or cigarettes, the smoker can count the limited number of puffs of the present smoking device as smoking a complete pipe full of tobacco materials or cigarette whereby the smoker can substantially reduce his/her nicotine intake. Additionally, secondhand smoke is also substantially eliminated by the self-extinguishing characteristic of the present pipe. Even if the individual places the pipe in an ashtray after only one puff, the secondhand smoke is substantially reduced by the limited time left before the burning tobacco materials self-extinguish.

To accomplish the foregoing and in accordance with an embodiment of the present invention, the safety smoking pipe of the present invention comprises a pipe body having first and second parts rotatable relative to one another. Particularly, the first part includes an elongated tube for containing packed tobacco. A screen is disposed at one end of the elongated tube. The second part telescopes within the opposite end of the elongated tube and preferably also comprises an elongated tube. The tubes of the first and second parts are rotatable relative to one another. The second part also terminates at an end opposite from the pipe body screen in a tip for insertion into the smoker's mouth. The tip preferably includes a filter, for example, a small cotton ball which, instead of requiring regular cleaning as in metal screen-type filters, may simply be replaced.

With the tobacco packed in the elongated tube of the first part, the tobacco materials adjacent the screen end of the pipe body and within the first tube may be lit by the smoker. It will be appreciated that the screen at the end of the pipe body essentially precludes exposing the lighted tobacco materials externally of the pipe body. It will also be appreciated that because the lighted tobacco materials are retained within the elongated tube adjacent the screen end, only a very limited, predetermined number of puffs may be smoked before the lighted tobacco extinguishes itself for lack of oxygen through the burnt ash at the screen end. Consequently, with this construction, the danger of fire from dropped lighted tobacco materials is substantially eliminated or minimized.

Also in accordance with a further embodiment of the present invention, there is provided an internal ash-cleaning device. The ash-cleaning device preferably includes a cleaning member carried by the pipe body, e.g., the second part, and which member extends within the tube of the first part, terminating in a cleaning head adjacent the inside surface of the screen. By rotating the first and second parts relative to one another, for example, rotating the two telescopically receivable tubes of the first and second parts relative to one another, the cleaning head is rotated relative to and brushes against the screen to displace the tobacco ash through the screen. With the burnt ash discarded, unburned tobacco material lies closely adjacent the screen within the pipe body. The cleaning device preferably comprises a one-piece elongated rod shaped at opposite ends to form the cleaning head and a connection to the second part, respectively.

In order to pack the tobacco materials within the pipe body when initially charging the pipe with tobacco or after cleaning and to advance the materials to the screen end of the pipe, a packing element is disposed within the pipe body. The packing element defines one end of a tobacco material-receiving cavity between the screen end of the elongated tube and the packing element. Preferably the packing element comprises a weight substantially disposed for free sliding movement along and within the pipe body whereby, upon shaking the pipe body with the screen end down, the weight compacts the tobacco material in the cavity and locates additional tobacco material directly adjacent the screen end whereby the pipe is readied for smoking. The packing element preferably is mounted directly for sliding movement along the cleaning member, e.g., the cleaning rod extending substantially the length of the pipe body. Further, the packing element is preferably comprised of two longitudinally extending semi-circular segments magnetically held one to the other about the cleaning rod. Thus, when the first and second parts are disassembled relative to one another, the packing member may also be removed from the cleaning rod. The packing member and cleaning rod can thus be cleaned separately to once again, upon assembly, enable the packing weight to freely slide along the cleaning rod and perform its function of packing and repacking the tobacco material within the elongated tube.

In a preferred embodiment according to the present invention, there is provided a safety smoking pipe comprising a pipe body including an elongated tube for containing tobacco and a screen disposed adjacent one end of the tube, a tip carried by the pipe body in communication with the tube and disposed adjacent an opposite end of the pipe body from the screen for insertion into a smoker's mouth and a cleaning member carried by the pipe body extending within the tube and terminating adjacent the screen in a cleaning head, the member and the screen being movable relative to one another to cause the head to brush the screen thereby to displace tobacco ash through the screen.

In a further preferred embodiment according to the present invention, there is provided a safety smoking pipe comprising a pipe body including an elongated tube for containing tobacco and a screen disposed adjacent one end of the tube, the tube defining a tobacco-receiving cavity closed at one end by the screen, a tip carried by the pipe body in communication with the tube and disposed adjacent an opposite end of the pipe body from the screen for insertion into a smoker's mouth and a packing element disposed within the pipe body at an opposite end of the cavity from the screen, the packing element being movable toward the screen to pack the tobacco in the cavity.

Accordingly, it is a primary object of the present invention to provide a novel and improved safety smoking pipe.

BEST MODE FOR CARRYING OUT THE INVENTION

Figure 2:
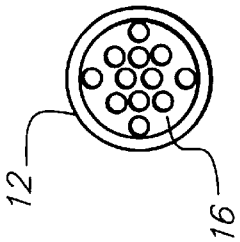
FIG. 2 is an end elevational view thereof.
Figure 1:
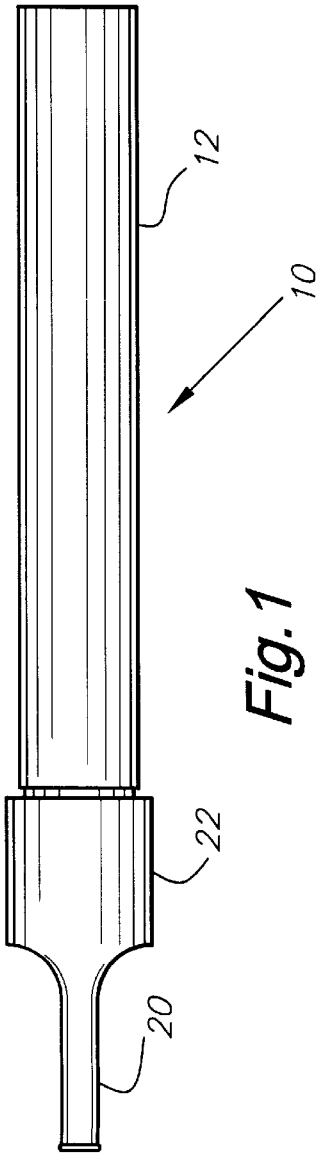
FIG. 1 is a side elevational view of a safety smoking pipe according to an embodiment of the present invention.
Figure 4:
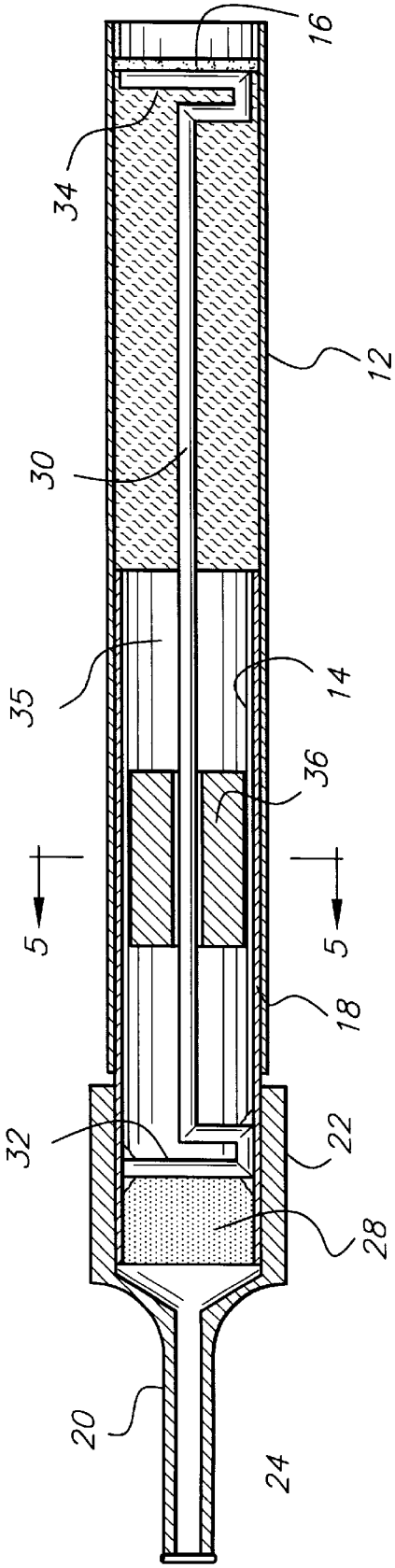
FIG. 4 is a cross-sectional view thereof in an assembled configuration.
Figure 3:
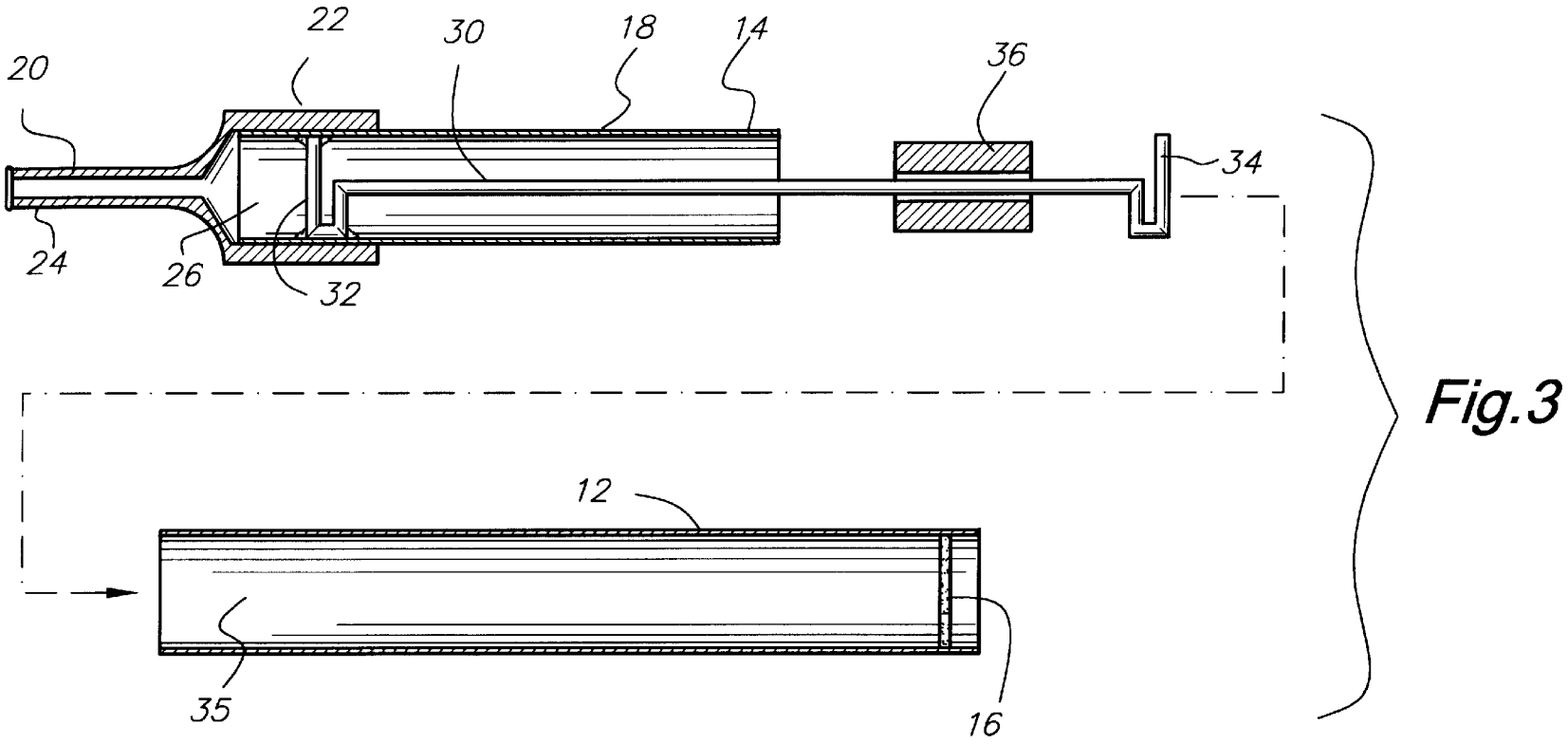
FIG. 3 is an exploded view of first and second parts forming sub-assemblies of the safety smoking pipe hereof.
Figure 5:
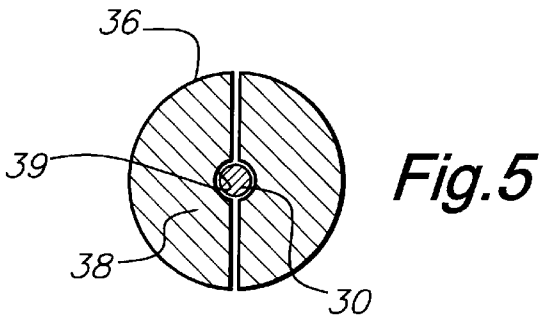
FIG. 5 is a cross-sectional view thereof taken generally about on line 5—5 in FIG. 4.

Referring now to the drawing figures, particularly to FIG. 1, there is illustrated a safety smoking pipe, generally designated 10, constructed in accordance with an embodiment of the present invention. Safety pipe 10 includes a pipe body comprised of first and second parts 12 and 14, respectively, as best illustrated in FIG. 3. The first part 12 preferably comprises an elongated tube for containing tobacco material and having a screen 16 disposed adjacent one end of tube 12. The opposite end of tube 12 is open for telescopically receiving a similar and preferred elongated tube 18 of the second part 14, for example, as illustrated in FIG. 4. The first tube 12 is adapted to receive tobacco materials through its open end such that the materials lie directly adjacent the screen 16.

The second part 14 includes a smoking tip 20 which may comprise a conventional, generally cylindrical collar 22 having a projecting longitudinally flattened tip end 24 for insertion into a smoker's mouth. The collar 22 receives one end of the tube 18 of the second part 14. The proximal end of tube 18 defines with the tip 20 a filter cavity 26 for receiving a filter 28. Preferably, filter 28 comprises a cotton wadding. The tube 18 and tip 20 may be secured one to the other by a frictional sliding fit or a screwthreaded engagement or otherwise for facilitating removal of the tip from the proximal end of the tube 18 for access to the filter cavity. Alternatively, the tip 20 and tube 18 can be suitably permanently secured to one another. In either case, the cotton wadding 28 can be readily replaced when necessary.

Secured along the inside surface of the tube 18 is a cleaning member 30 preferably comprised of an elongated rod disposed coaxially within the tube 18. The proximal end of the cleaning rod 30 may be shaped to facilitate securement to the interior surface of the tube 18. For example, the proximal end 32 of rod 30 is shaped to extend diametrically across the interior of tube 18 and is welded, for example, by a solder connection to the tube 18. Other configurations of the proximal end 32 of the cleaning rod 30 will occur to those of skill in this art.

It will be appreciated that with tobacco materials packed within tube 12 and bearing against screen 16, a lighting of the tobacco material through the screen will create an ash along the interior surface of the screen. This ash will deprive the tobacco material adjacent the screen end of the pipe from oxygen and hence limit the number of puffs of tobacco smoke to a predetermined number before the tobacco materials will self-extinguish. Thus, with the tobacco materials lit at the screen end, only one or a very few puffs from the ignited tobacco material may be provided the smoker before the tobacco materials extinguish of their own accord. This very beneficial result thus reduces the fire hazard from lighted tobacco materials if, for example, the pipe is dropped while lit.

The lit tobacco materials lie internally of the pipe and thus are not externally exposed, e.g., against flammable materials if the pipe is dropped. However, these beneficial results also necessitate a cleaning of the ash from the end of the tube 12.

The distal end of the cleaning member 30 comprises a cleaning head 34. For example, the rod may be bent to extend transversely across the full diameter of the screen 16. As illustrated in FIG. 4, when the first and second parts 12 and 14 are disposed in final assembly, the cleaning Is head 34 lies directly adjacent the interior surface of screen 16. With the tubes 12 and 18 telescopically receivable one within the other, it will be appreciated that relative rotation of the first and second parts, i.e., the tubes, causes the cleaning head 34 to brush against the interior surface of the screen. With the pipe oriented such that the screen end faces down, the cleaning head 34 thus displaces or brushes the tobacco ash through the screen 16.

Upon loading tobacco materials into part 12, it is desirable to pack the tobacco with the tube. Further, after ash has been cleaned from the distal end of the first part 12, it is also desirable to repack the remaining tobacco materials within the tube 12 such that the materials may lie directly adjacent the screen end 16. To accomplish this, a packing element 36 is disposed within the pipe body. From a review of the drawing figures, particularly FIG. 4, it will be seen that the packing element defines at one end a tobacco receiving cavity 35, the opposite end of the cavity being defined by the screen 16. The packing element 36 is preferably freely movable in an axial direction within the pipe. Thus, it will be appreciated that by disposing the pipe in an orientation with the screen end facing downwardly, the pipe can be shaken or displaced up and down to advance the packing element against the proximal end of the charge of tobacco materials within the tube 12, thereby displacing the tobacco materials toward the screen 16. Consequently, the packing element preferably comprises a weight which can be repeatedly brought to bear against the distal end of the tobacco material charged into cavity 35 to force the tobacco material against the screen end. As illustrated, the packing weight 36 is preferably mounted for sliding movement along the axially extending cleaning rod 35. While the packing weight can comprise a solid cylindrical element, to facilitate cleaning of the pipe, as well as to ensure relative free sliding movement of the packing element along the cleaning rod, the packing element is preferably provided in two axially extending, semi-cylindrical segments. Each segment 38 has a semi-cylindrical cavity 39 for engaging about the rod 30. Preferably, the segments 38 are connected to one another by magnetic attraction, the segments being formed of magnetic material. It will be appreciated, of course, that other types of securement may be provided to maintain the segments coupled to one another about the rod 30.

To use the safety smoking pipe of the present invention, the first and second parts are first disassembled to the configuration illustrated in FIG. 3. A charge of tobacco material is then disposed in the tube 12 and preferably manually packed against the screen 16. The first and second parts are then telescopically assembled. By manipulating, i.e., rotating the parts relative to one another, the cleaning head 34 can be disposed through the tobacco materials in tube 12 to lie adjacent the screen 16. When it is desired to smoke the pipe, the tobacco materials interior of the screen 16 may be lit through the screen. After a limited number of puffs, the ash at the end of the pipe body interior of the screen prevents oxygen from reaching additional tobacco and therefore extinguishes the tobacco materials. When it is desired to once again smoke the pipe, the parts are rotated relative to one another, thereby brushing the cleaning head 34 along the interior surface of the screen 16. It will be appreciated that with the pipe oriented with the screen end down, the ashes may be displaced from the pipe through the screen. Consequently, additional unburned tobacco materials are exposed to but spaced from the interior surface of screen 16. To repack the tobacco materials, the pipe may be shaken with the screen end down to cause the weight to impact against the distal end of the charge of tobacco, displacing it toward the screen end. The pipe is then ready for smoking.

To clean the pipe, the parts 12 and 14 may be disassembled from one another to the configuration illustrated in FIG. 3. By displacing the weighted segments 38 laterally away from one another and the rod 30, the cleaning rod 30 as well as the surfaces of the segments are readily accessible for cleaning. Additionally, the second part can be removed from the tip to replace the cotton filter. Once cleaned, a charge of fresh tobacco materials may be disposed in the tube 12 and the pipe parts reassembled.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A safety smoking pipe comprising:

a pipe body including an elongated tube for containing tobacco and a screen disposed adjacent one end of said tube;

a tip carried by said pipe body in communication with said tube and disposed adjacent an opposite end of said pipe body from said screen for insertion into a smoker's mouth;

a cleaning member carried by said pipe body extending within said tube and terminating adjacent said screen in a cleaning head, said member and said screen being movable relative to one another to cause said head to brush said screen thereby to displace tobacco ash through said screen; and said tube defining a tobacco-receiving cavity closed at one end by said screen and a packing element at an opposite end of said cavity from said screen, said packing element being movable toward said screen to pack the tobacco in said cavity.

2. A pipe according to claim 1 wherein said pipe body is formed of first and second parts rotatable relative to one another, said first part including said tube, said second part lying in communication with said first part through an end of said tube opposite said screen, said tip and said cleaning member being carried by said second part, said member and said screen being rotatable relative to one another upon relative rotation of said first and second parts.

3. A pipe according to claim 1 wherein said element comprises a weight substantially freely disposed within said pipe body whereby, upon shaking the pipe body with the screen end down, the weight compacts the tobacco in said cavity.

4. A pipe according to claim 1 wherein said pipe body is formed of first and second parts rotatable relative to one another, said first part including said tube, said second part lying in communication with said first part through an end of said tube opposite said screen, said tip and said cleaning member being carried by said second part, said member and said screen being rotatable relative to one another upon relative rotation of said first and second parts, said element being carried for sliding movement by and along said cleaning member.

5. A pipe according to claim 2 wherein said second part includes a tube, said tubes of said first and second parts being telescopically receivable within one another.

6. A pipe according to claim 2 including a filter in said second part.

7. A safety smoking pipe comprising:

a pipe body including an elongated tube for containing tobacco and a screen disposed adjacent one end of said tube, said tube defining a tobacco-receiving cavity closed at one end by said screen;

a tip carried by said pipe body in communication with said tube and disposed adjacent an opposite end of said pipe body from said screen for insertion into a smoker's mouth;

a packing element disposed within the pipe body at an opposite end of said cavity from said screen, said packing element being movable toward said screen to pack the tobacco in said cavity; and a cleaning member rotatable within said pipe body relative to said screen to displace tobacco ash through said screen, said element being carried for sliding movement by and along said cleaning member.

8. A pipe according to claim 1 wherein said pipe body is formed of first and second parts rotatable relative to one another, said first part including said tube with said second part lying in communication with said first part through an end of said tube opposite said screen, said tip being carried by said second part, said second part including a tube, said tubes of said first and second parts being telescopically receivable within one another.

9. A pipe according to claim 7 including a filter in said second part.

10. A pipe according to claim 7 wherein said element comprises a weight substantially freely disposed within said pipe body whereby, upon shaking the pipe body with the screen end down, the weight compacts the tobacco in said cavity.

11. A safety smoking pipe comprising:

a pipe body including an elongated tube for containing tobacco and a screen disposed adjacent one end of said tube;

a tip carried by said pipe body in communication with said tube and disposed adjacent an opposite end of said pipe body from said screen for insertion into a smoker's mouth;

a cleaning member carried by said pipe body extending within said tube and terminating adjacent said screen in a cleaning head, said member and said screen being movable relative to one another to cause said head to brush said screen thereby to displace tobacco ash through said screen;

said tube defining a tobacco-receiving cavity closed at one end by said screen and a packing element at an opposite end of said cavity from said screen, said packing element being movable toward said screen to pack the tobacco in said cavity;

said pipe body being formed of first and second parts rotatable relative to one another, said first part including said tube, said second part lying in communication with said first part through an end of said tube opposite said screen, said tip and said cleaning member being carried by said second part, said member and said screen being rotatable relative to one another upon relative rotation of said first and second parts, said element being carried for sliding movement by and along said cleaning member; and said element surrounding said cleaning member within said pipe body and being longitudinally split to form a pair of segments, said segments being removable laterally from said member upon separation of said segments from one another.

12. A pipe according to claim 4 wherein said element comprises a weight substantially freely disposed within said pipe body about said cleaning member whereby, upon shaking the pipe body with the screen end down, the weight compacts the tobacco in said cavity, said segments being held together about said member by magnetic attraction.

13. A safety smoking pipe comprising:

a pipe body including an elongated tube for containing tobacco and a screen disposed adjacent one end of said tube, said tube defining a tobacco-receiving cavity closed at one end by said screen;

a tip carried by said pipe body in communication with said tube and disposed adjacent an opposite end of said pipe body from said screen for insertion into a smoker's mouth;

a packing element disposed within the pipe body at an opposite end of said cavity from said screen, said packing element being movable toward said screen to pack the tobacco in said cavity;

a cleaning member rotatable within said pipe body relative to said screen to displace tobacco ash through said screen, said element being carried for sliding movement by and along said cleaning member; and said element surrounding said cleaning member within said pipe body and being longitudinally split to form a pair of segments, said segments being removable laterally from said member upon separation of said parts from one another.

14. A pipe according to claim 13 wherein said element comprises a weight substantially freely disposed within said pipe body about said cleaning member whereby, upon shaking the pipe body with the screen end down, the weight compacts the tobacco in said cavity, said segments being held together about said member by magnetic attraction.

* * * * *